US009051169B2

(12) United States Patent
Pearce et al.

(10) Patent No.: US 9,051,169 B2
(45) Date of Patent: Jun. 9, 2015

(54) PORTABLE CUSHIONS INCLUDING DEFORMABLE WALL MEMBERS, AND RELATED METHODS

(71) Applicant: EdiZONE, LLC, Alpine, UT (US)

(72) Inventors: Tony M. Pearce, Alpine, UT (US); Russell Whatcott, Eagle Mountain, UT (US)

(73) Assignee: EDIZONE, LLC, Alpine, UT (US)

( * ) Notice: Subject to any disclaimer, the term of this patent is extended or adjusted under 35 U.S.C. 154(b) by 0 days.

(21) Appl. No.: 14/213,229

(22) Filed: Mar. 14, 2014

(65) Prior Publication Data

US 2014/0259426 A1 Sep. 18, 2014

Related U.S. Application Data

(60) Provisional application No. 61/798,841, filed on Mar. 15, 2013.

(51) Int. Cl.

| | |
|---|---|
| ***A47C 7/62*** | (2006.01) |
| ***B68G 7/00*** | (2006.01) |
| ***A47C 27/08*** | (2006.01) |
| ***A47C 7/02*** | (2006.01) |

(52) U.S. Cl.
CPC ..... *B68G 7/00* (2013.01); *A47C 27/085* (2013.01); *A47C 7/021* (2013.01)

(58) Field of Classification Search
USPC ..... 5/652, 653, 654
See application file for complete search history.

(56) References Cited

U.S. PATENT DOCUMENTS

| | | | | |
|---|---|---|---|---|
| 3,485,787 | A | 12/1969 | Haefele et al. | |
| 3,676,387 | A | 7/1972 | Lindolf | |
| 3,827,999 | A | 8/1974 | Crossland | |
| 3,846,856 | A * | 11/1974 | Tu | 5/420 |
| 4,151,057 | A | 4/1979 | Hansen et al. | |
| 4,176,240 | A | 11/1979 | Sabia | |
| 4,190,918 | A | 3/1980 | Harvell | |
| 4,369,284 | A | 1/1983 | Chen et al. | |
| 4,509,510 | A * | 4/1985 | Hook | 601/28 |
| 4,713,854 | A * | 12/1987 | Graebe | 5/652 |
| 4,833,193 | A | 5/1989 | Sieverding et al. | |
| 4,925,241 | A | 5/1990 | Geraci | |
| 5,153,254 | A | 10/1992 | Chen et al. | |
| 5,297,848 | A | 3/1994 | Grinnell | |
| 5,549,743 | A | 8/1996 | Pearce | |
| 5,731,359 | A | 3/1998 | Moser et al. | |
| 5,749,111 | A | 5/1998 | Pearce | |
| 5,760,117 | A | 6/1998 | Chen et al. | |
| 5,334,646 | B1 | 9/1998 | Chen | |
| 5,802,643 | A * | 9/1998 | Sloot | 5/656 |
| 5,855,415 | A | 1/1999 | Lilley | |
| 5,870,785 | A * | 2/1999 | Hoorens | 5/652.1 |

(Continued)

*Primary Examiner* — Robert G Santos
*Assistant Examiner* — Ifeolu Adeboyejo
(74) *Attorney, Agent, or Firm* — TraskBritt

(57) ABSTRACT

Portable cushions include first and second portions that may be folded relative to one another between a folded state in which the cushion may be carried by a user and an unfolded state in which the cushion may be used to cushion the body of a person or another object. Each of the first and second portions of the cushion includes deformable wall members that are located and configured to define voids therebetween, such that the deformable wall members may be displaced into adjacent voids upon deformation of the deformable wall members during cushioning. Methods of manufacturing such portable cushions include the formation of such first and second portions of a cushion.

22 Claims, 6 Drawing Sheets

(56) References Cited

U.S. PATENT DOCUMENTS

| | | | | |
|---|---|---|---|---|
| 5,994,450 | A | 11/1999 | Pearce et al. | |
| 6,026,527 | A | 2/2000 | Pearce | |
| 6,108,835 | A * | 8/2000 | Hwang | 5/420 |
| 6,117,176 | A | 9/2000 | Chen et al. | |
| 6,413,458 | B1 | 7/2002 | Pearce | |
| 6,446,289 | B1 * | 9/2002 | Su et al. | 5/709 |
| 6,552,109 | B1 | 4/2003 | Chen | |
| 6,581,227 | B1 * | 6/2003 | Obermaier | 5/654 |
| 6,839,928 | B1 | 1/2005 | Woodall et al. | |
| 6,865,759 | B2 | 3/2005 | Pearce | |
| 7,060,213 | B2 | 6/2006 | Pearce | |
| 7,794,022 | B2 * | 9/2010 | Caruso et al. | 297/452.56 |
| 7,964,664 | B2 | 6/2011 | Pearce | |
| 8,075,981 | B2 | 12/2011 | Pearce et al. | |
| 8,087,726 | B2 * | 1/2012 | Chen | 297/284.5 |
| 8,424,137 | B1 | 4/2013 | Pearce et al. | |
| 8,434,748 | B1 | 5/2013 | Pearce et al. | |
| 8,628,067 | B2 | 1/2014 | Pearce et al. | |
| 2008/0016622 | A1 * | 1/2008 | Prust | 5/653 |
| 2008/0216245 | A1 * | 9/2008 | Liners | 5/654 |
| 2010/0206472 | A1 * | 8/2010 | Kim | 156/247 |
| 2011/0067160 | A1 * | 3/2011 | Grogro et al. | 2/23 |

* cited by examiner

PORTABLE CUSHIONS INCLUDING DEFORMABLE WALL MEMBERS, AND RELATED METHODS

CROSS-REFERENCE TO RELATED APPLICATION

The present application claims the benefit of U.S. Provisional Patent Application Ser. No. 61/798,841, which was filed on Mar. 15, 2013, and titled "Portable Cushions Including Deformable Wall Members, and Related Methods," the disclosure of which is incorporated herein in its entirety by this reference.

FIELD

Embodiments of the disclosure relate generally to portable seat cushions, and to methods of making portable seat cushions.

BACKGROUND

Cushions are used for a variety of purposes. For example, seat cushions are used over hard surfaces to cushion the body of person or other object resting on the hard surface. Cushions generally include relatively soft and flexible cushioning material, and a cover is often provided over the soft and flexible cushioning material. For example, many cushions employ polyurethane foam as a cushioning material, and a fabric cover is often provided over the polyurethane foam.

The inventor of the present invention has also previously invented various cushioning materials and cushions that include such cushioning materials. For example, the following patents and publications disclose various cushioning materials and cushions including such cushioning materials: U.S. Pat. No. 5,994,450, issued Nov. 30, 1999, and titled "Gelatinous Elastomer and Methods of Making and Using the Same and Articles Made Therefrom"; U.S. Pat. No. 7,964,664, issued Jun. 21, 2011, and titled "Gel with Wide Distribution of MW in Mid-Block"; and U.S. Pat. No. 4,369,284, issued Jan. 18, 1983, and titled "Thermoplastic Elastomer Gelatinous Compositions"; the disclosures of which are hereby incorporated herein in their entireties by this reference.

BRIEF SUMMARY

In some embodiments, the present disclosure includes a portable cushion having a generally planar first portion and a generally planar second portion coupled with the first portion. The first portion and the second portion are configured to fold relative to one another between a first state of the portable cushion and a second state of the portable cushion. In the first state of the portable cushion, the first portion and the second portion are disposed generally parallel to one another in a common plane. In the second state of the portable cushion, the first portion and the second portion are disposed side-by-side and generally parallel to one another in separate planes. Each of the first portion and the second portion has a first major surface and a second major surface. Each of the first and second portions further includes deformable wall members extending between the first major surface and the second major surface. The deformable wall members are located and configured to define voids therebetween, such that the deformable wall members may be displaced into adjacent voids upon deformation of the deformable wall members. Each of the deformable wall members comprises an elastomeric material. The first major surface of the first portion is disposed at least substantially coplanar with the first major surface of the second portion when the portable cushion is in the first state, and one of the first major surface and the second major surface of the first portion is disposed adjacent one of the first major surface and the second major surface of the second portion when the portable cushion is in the second state.

Additional embodiments of the disclosure include methods of making portable cushions as described herein.

For example, in some embodiments, the present disclosure includes a method of manufacturing a portable cushion in which a generally planar first portion is formed, and a generally planar second portion is formed that is coupled with the first portion. The first portion and the second portion are configured to fold relative to one another between a first state of the portable cushion in which the first portion and the second portion are disposed generally parallel to one another in a common plane, and a second state of the portable cushion in which the first portion and the second portion are disposed side-by-side and generally parallel to one another in separate planes. Each of the first portion and the second portion are formed to comprise a first major surface and a second major surface. Further, each of the first portion and the second portion are formed to further include deformable wall members extending between the first major surface and the second major surface. The deformable wall members are located and configured to define voids therebetween, such that the deformable wall members may be displaced into adjacent voids upon deformation of the deformable wall members. Each of the deformable wall members may comprise an elastomeric material. Further, the portable cushion is formed such that the first major surface of the first portion is disposed at least substantially coplanar with the first major surface of the second portion when the portable cushion is in the first state, and such that one of the first major surface and the second major surface of the first portion is disposed adjacent one of the first major surface and the second major surface of the second portion when the portable cushion is in the second state.

DETAILED DESCRIPTION

Figure 1A:
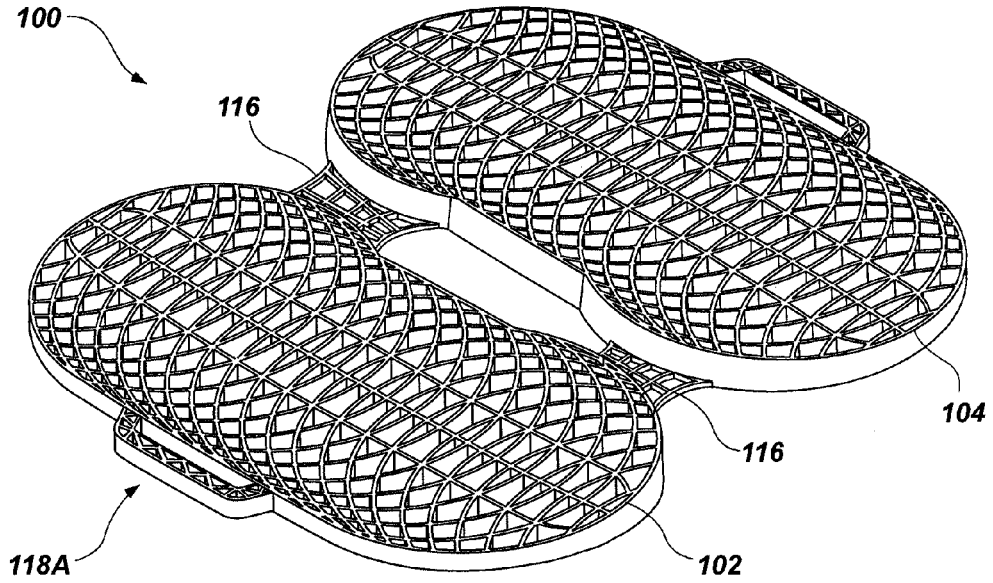
FIG. 1A is a perspective view of a portable and foldable cushion in an un-folded first state.

As used herein, the term "cushion" means and includes any deformable device intended for use in cushioning one body relative to another. As a non-limiting example, cushioning elements (e.g., seat cushions) include materials intended for use in cushioning the body of a person relative to another object (e.g., a chair seat) that might otherwise abut against the body of the person.

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

As used herein, the term "elastomeric block copolymer" means and includes an elastomeric polymer having groups or blocks of homopolymers linked together, such as A-B diblock copolymers and A-B-A triblock copolymers. A-B diblock copolymers have two distinct blocks of homopolymers. A-B-A triblock copolymers have two blocks of a single homopolymer (A) each linked to a single block of a different homopolymer (B).

As used herein, the term "plasticizer" means and includes a substance added to another material (e.g., an elastomeric polymer) to increase a workability of the material. For example, a plasticizer may increase the flexibility, softness, or extensibility of the material. Plasticizers include, without limitation, hydrocarbon fluids, such as mineral oils. Hydrocarbon plasticizers may be aromatic or aliphatic.

As used herein, the term "elastomeric material" means and includes elastomeric polymers and mixtures of elastomeric polymers with plasticizers and/or other materials. Elastomeric materials are elastic (i.e., capable of recovering size and shape after deformation). Elastomeric materials include, without limitation, materials referred to in the art as "elastomer gels," "gelatinous elastomers," or simply "gels."

The illustrations presented herein are not actual views of any particular cushion or material, but are merely idealized representations employed to describe embodiments of the present disclosure. Elements common between figures may retain the same numerical designation.

FIGS. 1A through 1F and 2A through 2F illustrate an embodiment of a foldable and portable cushion 100. The cushion 100 is sized and configured to allow a person to fold the cushion 100 into a smaller folded state or configuration, which is shown in FIGS. 2A through 2F, when the person desires to carry the cushion 100 from one place to another or for storage of the cushion 100, and to unfold the cushion into an unfolded configuration or state, which is shown in FIGS. 1A through 1F, when it is desired to employ the cushion 100. The cushion 100 may be employed, for example, as a seat cushion positioning the cushion 100 in the unfolded state on a surface of a chair or other support surface, and sitting on the cushion 100 such that the buttocks of the person sitting on the cushion 100 are supported and cushioned by the cushion 100.

The cushion 100 includes a generally planar first portion 102 and a generally planar second portion 104, which is coupled with the first portion 102. The first portion 102 and the second portion 104 are configured to fold relative to one another between the first unfolded state of the portable cushion 100 (FIGS. 1A-1F) in which the first portion 102 and the second portion 104 are disposed generally parallel to one another in a common plane, and the second unfolded state of the portable cushion 100 (FIGS. 2A-2F) in which the first portion 102 and the second portion 104 are disposed side-by-side and generally parallel to one another in separate planes.

Each of the first portion 102 and the second portion 104 has a first major surface 106 on a first side of the portion 102, 104, and a second major surface 108 on an opposite side of the portion 102, 104. Each of the first portion 102 and the second portion 104 also has one or more lateral side surfaces 110 that extend between the first major surface 106 and the second major surface 108 along a periphery of the respective portions 102, 104.

Each of the first portion 102 and the second portion 104 comprises deformable wall members 112 that extend between the first major surface 106 and the second major surface 108 of the respective portions 102, 104 of the cushion 100. The deformable wall members 112 are located and configured to define voids 114 therebetween, such that the deformable wall members 112 may be displaced into the adjacent voids 114 upon deformation of the deformable wall members 112 when the cushion 100 is used to cushion the body of a person or object. In other words, when a person sits on the portions 102, 104 of the cushion 100, the deformable wall members 112 under the buttocks of the person sitting on the cushion 100 may be displaced laterally into the voids 114 between the deformable members 112 as the deformable members 112 are compressed in the direction extending between the major surfaces 106, 108 of the portions 102, 104 of the cushion 100.

The deformable wall members 112 may be formed from and comprise an elastomeric material. Elastomeric materials are described in, for example, U.S. Pat. No. 5,994,450, issued Nov. 30, 1999, and titled "Gelatinous Elastomer and Methods of Making and Using the Same and Articles Made Therefrom"; U.S. Pat. No. 7,964,664, issued Jun. 21, 2011, and titled "Gel with Wide Distribution of MW in Mid-Block"; and U.S. Pat. No. 4,369,284, issued Jan. 18, 1983, and titled "Thermoplastic Elastomer Gelatinous Compositions"; the disclosures of each of which are incorporated herein in their entirety by this reference. The elastomeric material may include an elastomeric polymer and a plasticizer. The elastomeric material may be a gelatinous elastomer (also referred to in the art as gel, elastomer gel, or elastomeric gel), a thermoplastic elastomer, a natural rubber, a synthetic elastomer, a blend of natural and synthetic elastomers, etc.

The elastomeric polymer may be an A-B-A triblock copolymer such as styrene ethylene propylene styrene (SEPS), styrene ethylene butylene styrene (SEBS), and styrene ethylene ethylene propylene styrene (SEEPS). For example, A-B-A triblock copolymers are currently commercially available from Kuraray America, Inc., of Houston, Tex., under the trade name SEPTON® 4055, and from Kraton Polymers, LLC, of Houston, Tex., under the trade names KRATON® E1830, KRATON® G1650, and KRATON® G1651. In these examples, the "A" blocks are styrene. The "B" block may be rubber (e.g., butadiene, isoprene, etc.) or hydrogenated rubber (e.g., ethylene/propylene or ethylene/ butylene or ethylene/ethylene/propylene) capable of being plasticized with mineral oil or other hydrocarbon fluids. The elastomeric material may include elastomeric polymers other than styrene-based copolymers, such as non-styrenic elastomeric polymers that are thermoplastic in nature or that can be solvated by plasticizers or that are multi-component thermoset elastomers.

The elastomeric material may include one or more plasticizers, such as hydrocarbon fluids. For example, elastomeric materials may include aromatic-free food-grade white paraffinic mineral oils, such as those sold by Sonneborn, Inc., of Mahwah, N.J., under the trade names BLANDOL® and CARNATION®.

The elastomeric material may have one or more fillers (e.g., lightweight microspheres). Fillers may affect thermal properties, density, processing, etc., of the elastomeric material. For example, hollow microspheres (e.g., hollow glass microspheres or hollow acrylic microspheres) may decrease the thermal conductivity of the elastomeric material by acting as an insulator because such hollow microspheres (e.g., hollow glass microspheres or hollow acrylic microspheres) may have lower thermal conductivity than the plasticizer or the polymer. As another example, metal particles (e.g., aluminum, copper, etc.) may increase the thermal conductivity of the resulting elastomeric material because such particles may have greater thermal conductivity than the plasticizer or polymer. Microspheres filled with wax or another phase-change material (i.e., a material formulated to undergo a phase change near a temperature at which a cushioning element may be used) may provide temperature stability at or near the phase-change temperature of the wax or other phase-change material within the microspheres (i.e., due to the heat of fusion of the phase change). The phase-change material may have a melting point from about 20° C. to about 45° C.

The elastomeric material may also include antioxidants. Antioxidants may reduce the effects of thermal degradation during processing or may improve long-term stability. Antioxidants include, for example, pentaerythritol tetrakis(3-(3,5-di-tert-butyl-4-hydroxyphenyl) propionate), commercially available as IRGANOX® 1010, from BASF Corp., of Iselin, N.J. or as EVERNOX®-10, from Everspring Chemical, of Taichung, Taiwan; octadecyl-3-(3,5-di-tert-butyl-4-hydroxyphenyl)propionate, commercially available as IRGANOX® 1076, from BASF Corp. or as EVERNOX® 76, from Everspring Chemical; and tris(2,4-di-tert-butylphenyl)phosphite, commercially available as IRGAFOS® 168, from BASF Corp. or as EVERFOS® 168, from Everspring Chemical. One or more antioxidants may be combined in a single formulation of elastomeric material. The use of antioxidants in mixtures of plasticizers and polymers is described in columns 25 and 26 of U.S. Pat. No. 5,994,450, previously incorporated by reference. The elastomeric material may include up to about 5 wt % antioxidants. For instance, the elastomeric material may include from about 0.10 wt % to about 1.0 wt % antioxidants.

In some embodiments, the elastomeric material may include a pigment or a combination of pigments. Pigments may be aesthetic and/or functional. That is, pigments may provide the deformable wall members 112 with an appearance that is appealing to consumers. In addition, an elastomeric material having a dark color may absorb radiation differently than elastomeric material having a light color.

The elastomeric material of the deformable wall members 112 may include any type of gelatinous elastomer. For example, the elastomeric material may include a melt-blend of one part by weight of a styrene-ethylene-ethylene-propylene-styrene (SEEPS) elastomeric triblock copolymer (e.g., SEPTON® 4055) with two parts by weight of a 70-weight straight-cut white paraffinic mineral oil (e.g., CARNATION® white mineral oil) and, optionally, pigments, antioxidants, and/or other additives.

The elastomeric material may include a material that returns to its original shape after deformation, and that may be elastically stretched. The elastomeric material may be rubbery in feel, but may deform to the shape of an object applying a deforming pressure better than conventional rubber materials, and may have a durometer hardness lower than conventional rubber materials. For example, the elastomeric material may have a hardness on the Shore A scale of less than about 50, from about 0.1 to about 50, or less than about 5.

The elastomeric material may be generally nonsticky, such that the deformable wall members 112 may return to their original shape after deformation. That is, the elastomeric material may be sufficiently nonsticky so that deformable walls 112 do not stick to one another or do not remain stuck to one another after a deforming force is removed. Thus, any contact between adjacent deformable walls 112 may cease immediately or soon after the force is removed. The elastomeric material may be formulated to have any selected stickiness or tackiness, such as to control the rate of response to removal of a load.

As can be seen from FIGS. 1C through 1F, the first major surface 106 of the first portion 102 of the cushion 100 may be disposed at least substantially coplanar with the first major surface 106 of the second portion 104 when the portable cushion 100 is in the unfolded state (FIGS. 1A-1F), and, as can be seen from FIGS. 2C through 2F, the second major surface 108 of the first portion 102 is disposed adjacent the second major surface 108 of the second portion 104 when the portable cushion 100 is in the folded state (FIGS. 2A-2F).

In some embodiments, the deformable wall members 112 of the first portion 102 and the deformable walls 112 of the second portion 104 may be part of a single, unitary body of elastomeric material. For example, the first and second portions 102, 104 may be formed by molding elastomeric material in a cavity of a mold (e.g., a bi-part mold having two mold halves) to form a single, unitary body.

The cushion 100 may further include one or more hinge members 116 that extend between the first portion 102 and the second portion 106 and couples the portions 102, 104 together in a manner that allows the first and second portions 102, 104 to fold relative to one another between the folded and unfolded configurations of the cushion 100. In some embodiments, the hinge members 116 may comprise an elastomeric material, and may be comprised of the same elastomeric material of the deformable walls 112 of the first and second portions 102, 104. In embodiments in which the deformable wall members 112 of the first and second portions 102, 104 are part of a single, unitary body of elastomeric material, at least a portion of the one or more hinge members 116 also may comprise an integral portion or portions of that same single, unitary body of elastomeric material.

The cushion 100 may further include a handle 118 that is configured to allow a person to carry the cushion 100. In some embodiments, the handle 118 may comprise an elastomeric material, and may be comprised of the same elastomeric material of the deformable walls 112 of the first and second portions 102, 104. In embodiments in which the deformable wall members 112 of the first and second portions 102, 104 are part of a single, unitary body of elastomeric material, at least a portion of the handle 118 also may comprise an integral portion or portions of that same single, unitary body of elastomeric material. In some embodiments, the first portion 102 of the cushion 100 may comprise a first portion 118A of the handle 118, and the second portion 104 of the cushion 100 may comprise a second portion 118B of the handle 118. When the cushion 100 is in the folded state shown in FIGS. 2A-2F, the first portion 118A may be disposed adjacent the second portion 118B in such a manner as to form the handle 118, which may be gripped by the hand of a user and used to carry the cushion 100.

Figure 1B:
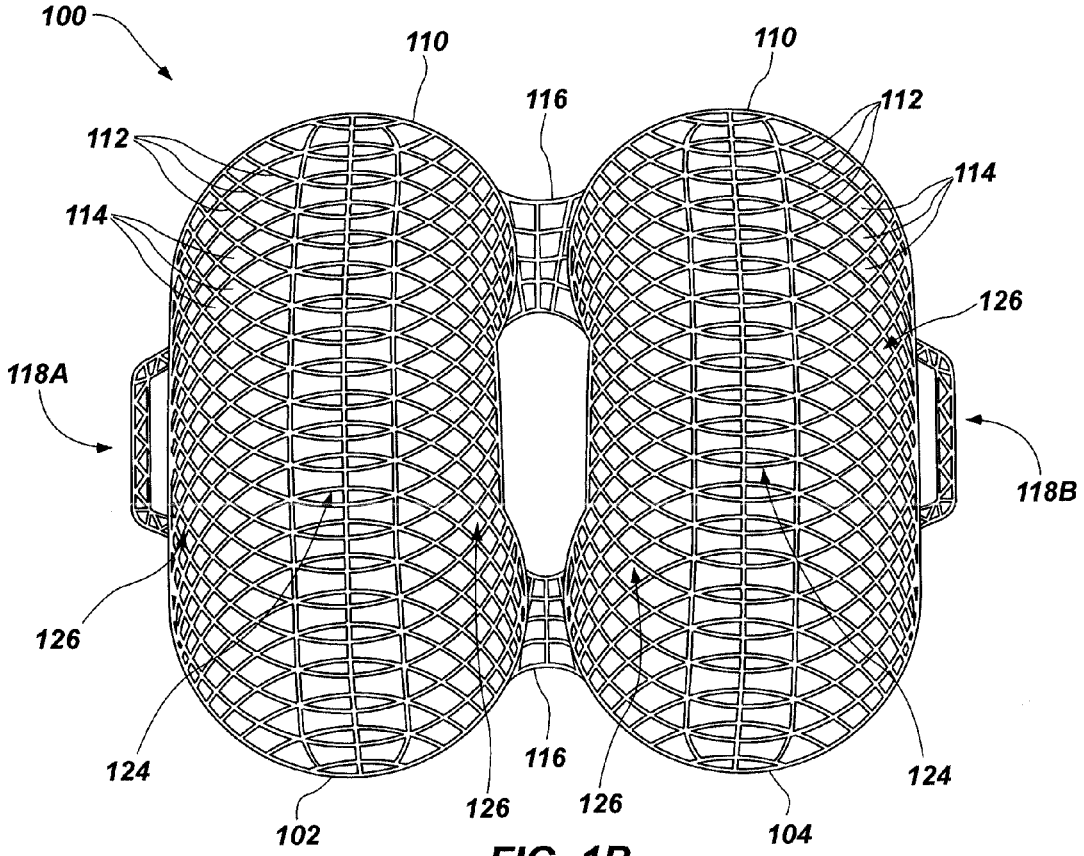
FIG. 1B is a top plan view of the cushion in the un-folded first state.
Figure 1C:
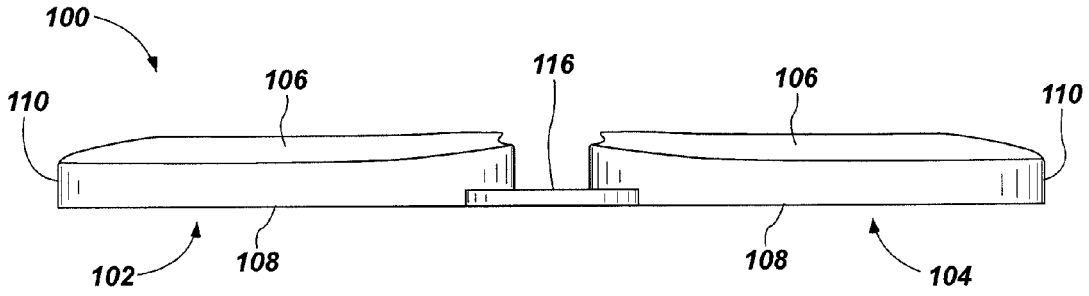
FIG. 1C is a front side view of the cushion in the un-folded first state.
Figure 1D:
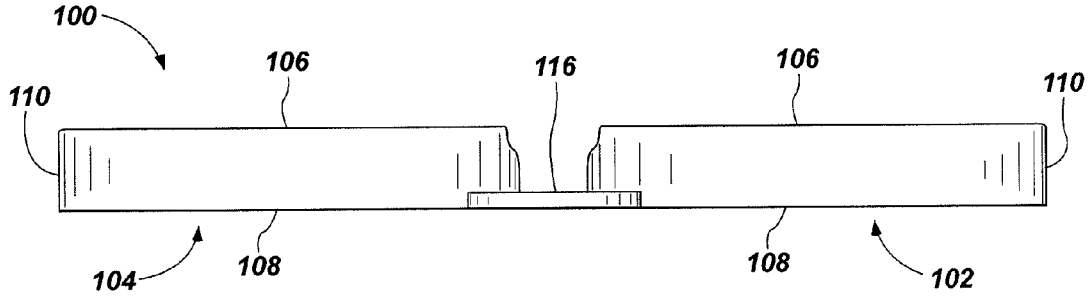
FIG. 1D is a back side view of the cushion in the un-folded first state.
Figure 1E:
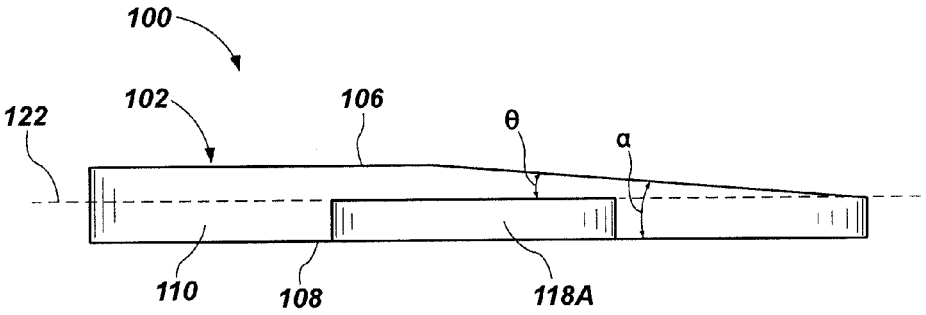
FIG. 1E is a left side view of the cushion in the un-folded first state.
Figure 1F:
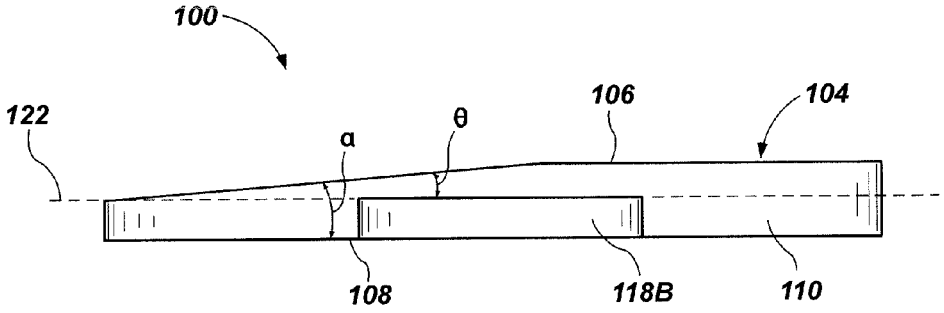
FIG. 1F is a right side view of the cushion in the un-folded first state.
Figure 2A:
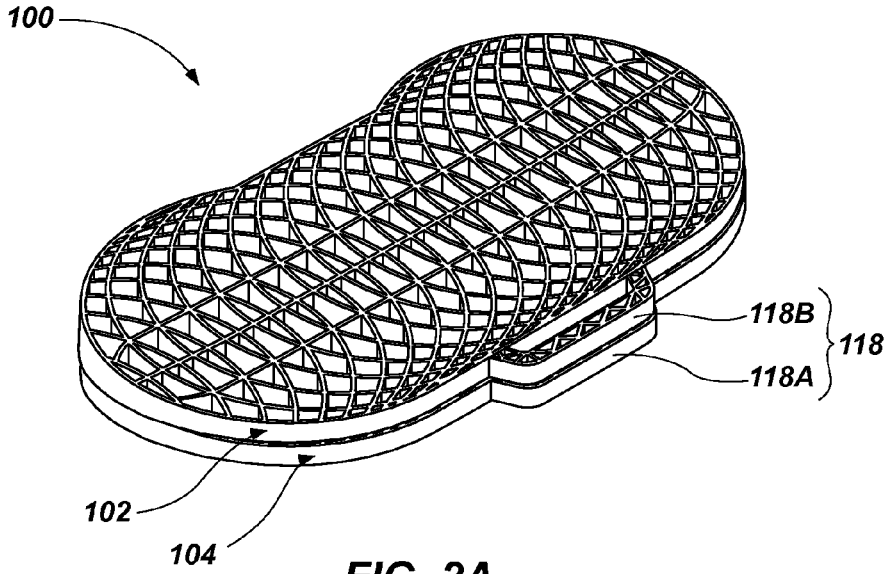
FIG. 2A is a perspective view of the portable and foldable cushion in a folded second state.
Figure 2B:
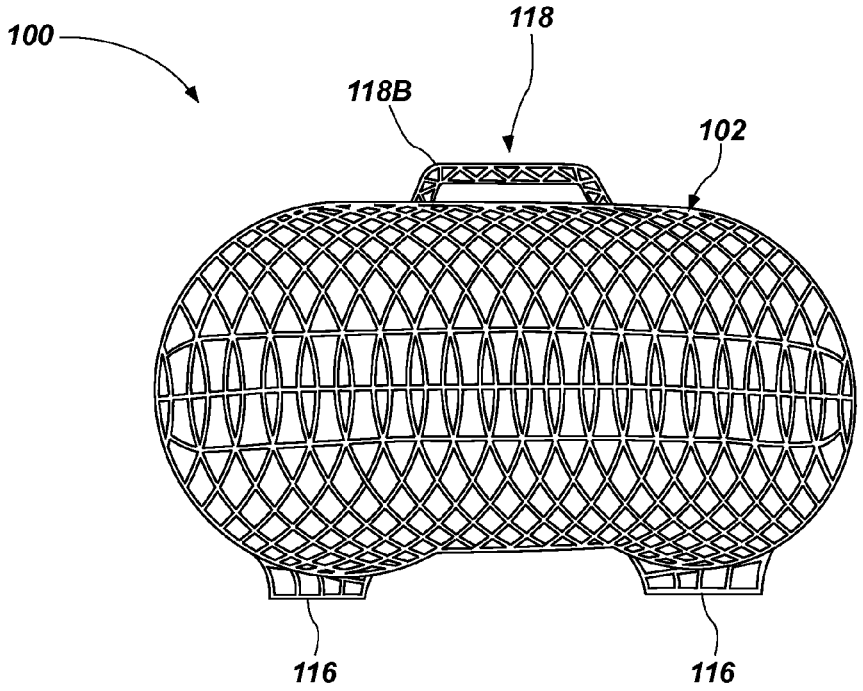
FIG. 2B is a top plan view of the cushion of FIG. 2A in the folded second state.
Figure 2C:
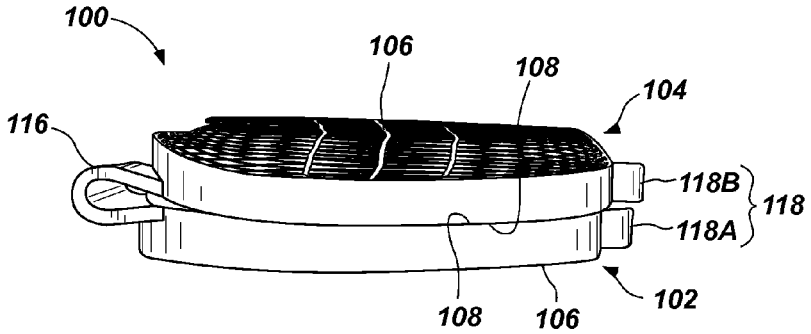
FIG. 2C is a front side view of the cushion of FIG. 2A in the folded second state.
Figure 2D:
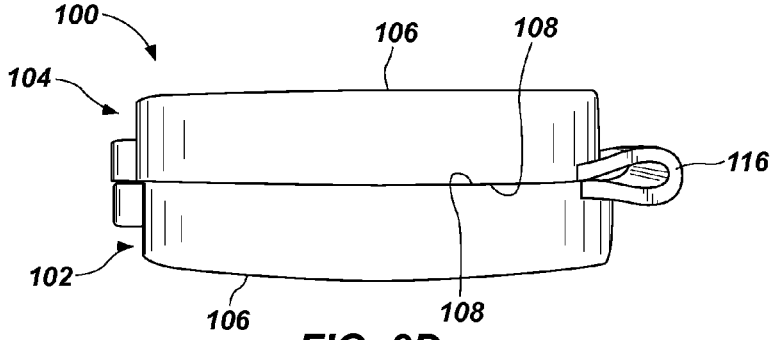
FIG. 2D is a back side view of the cushion of FIG. 2A in the folded second state.
Figure 2E:
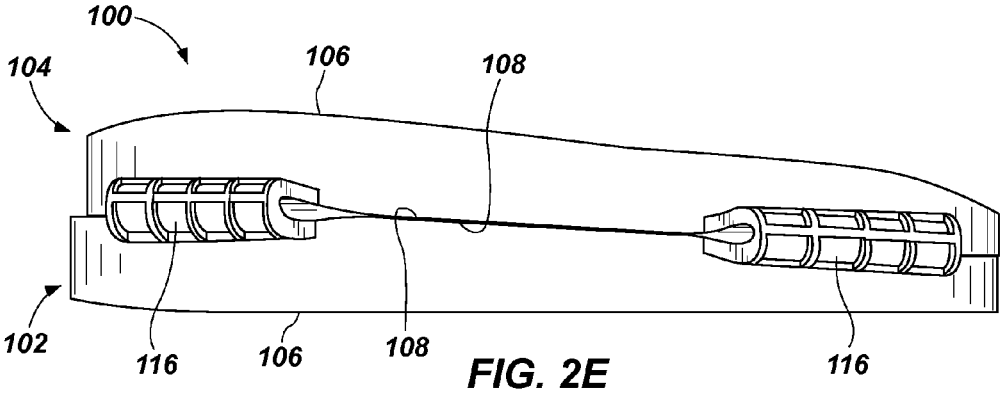
FIG. 2E is a left side view of the cushion of FIG. 2A in the folded second state.
Figure 2F:
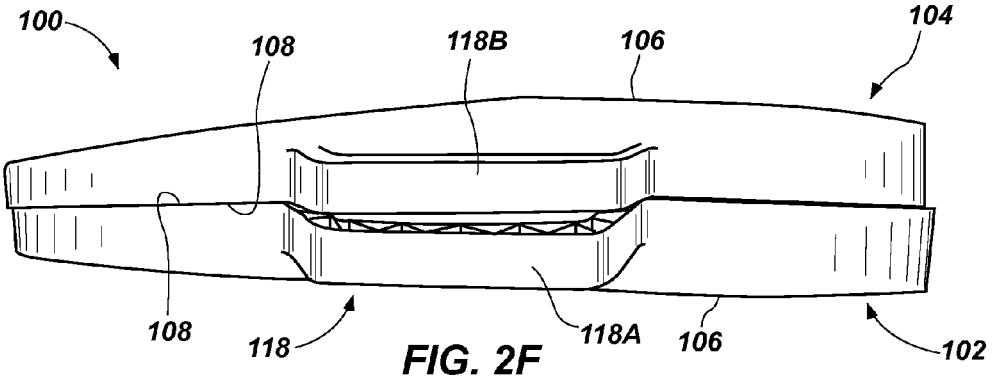
FIG. 2F is a right side view of the cushion of FIG. 2A in the folded second state.
Figure 3:
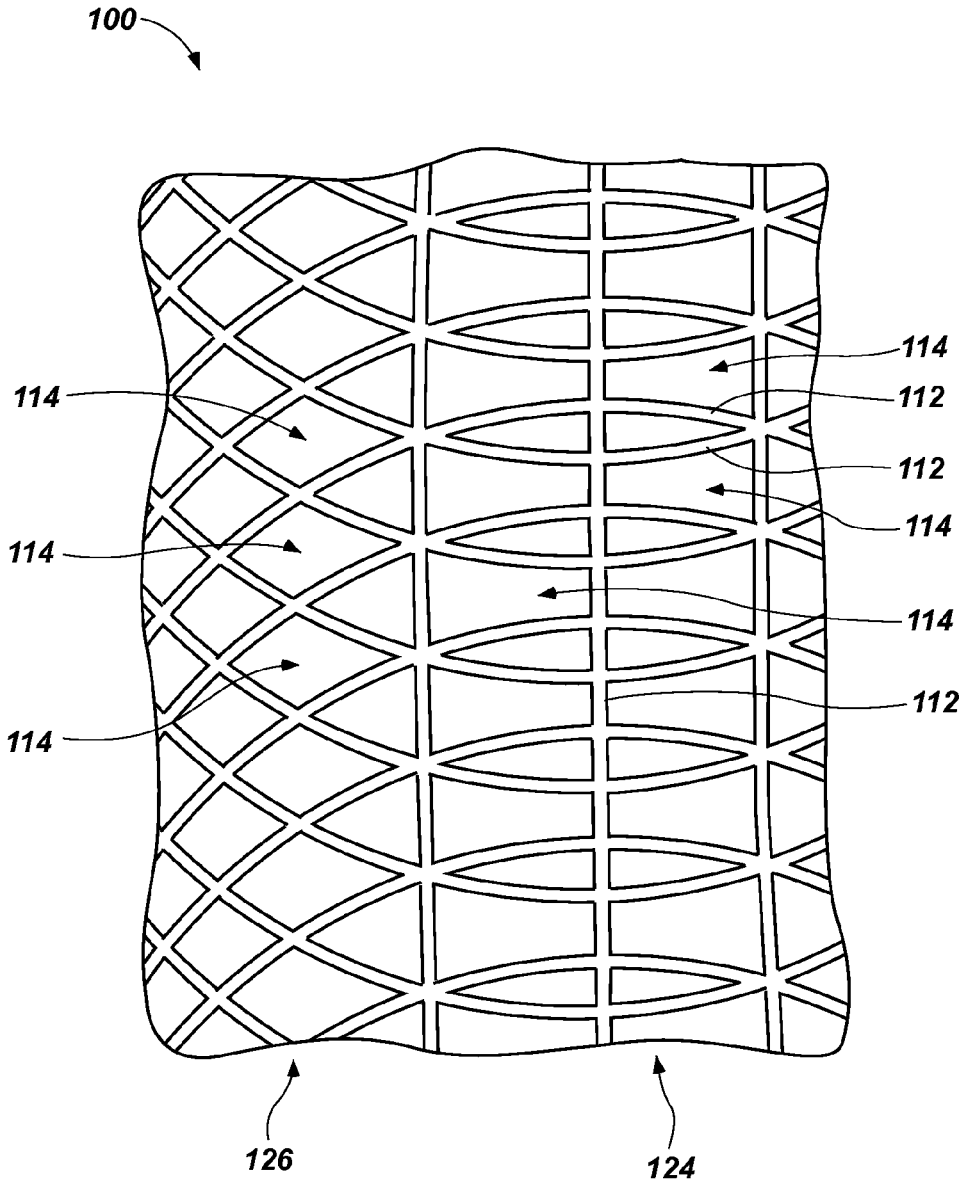
FIG. 3 is an enlarged view of a portion of FIG. 1B.
Figure 4:
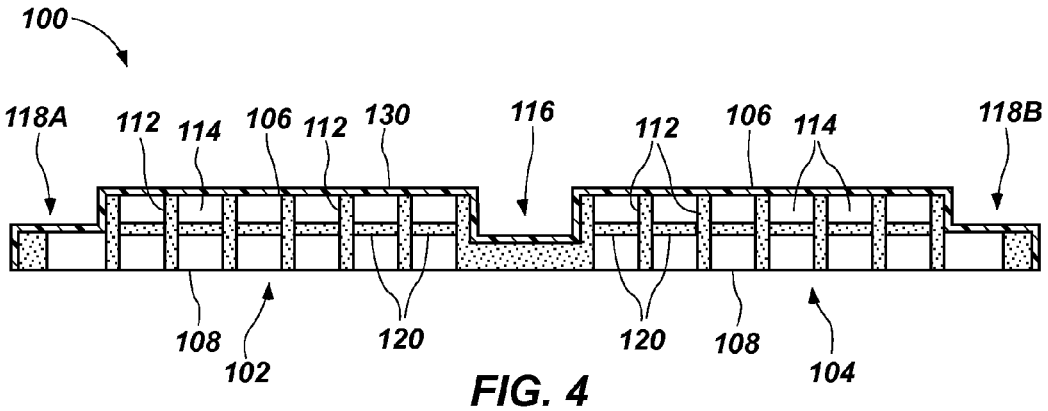
FIG. 4 is a simplified drawing of a front side view of the cushion of FIGS. 1A-1F and 2A-2F like that of FIG. 1C, and illustrates a cover on a portion of the cushion.

FIG. 3 is an enlarged view of a portion of FIG. 1B. FIGS, 4 and 5 are front side views of the cusion 100. As shown in FIG. 4, in some embodiments, each of the first portion 102 and the second portion 104 of the cushion 100 further includes stabilizing cross-members 120 that extend transversely between the deformable wall members 112. The stabilizing cross-members 120 may be located and configured to counteract lateral deformation of the deformable wall members 112 into the voids 114 therebetween. The stabilizing cross-members 120 may comprise an elastomeric material. In some embodiments, the stabilizing cross-members 120 may be comprised of the same elastomeric material of the deformable walls 112 of the first and second portions 102, 104. Additionally, the stabilizing cross-members 120 may be integrally formed with the deformable wall members 112. In embodiments in which the deformable wall members 112 of the first and second portions 102, 104 are part of a single, unitary body of elastomeric material, the stabilizing cross-members 120 also may comprise an integral portion or portions of that same single, unitary body of elastomeric material.

As shown in the figures, the stabilizing cross-members 120 may have the shape of two beam members oriented perpendicular to one another in the shape of a cross. In other embodiments, the stabilizing cross-members 120 may have the shape of only one beam member, or more than two beam members. In additional embodiments, the stabilizing cross-members 120 may comprise multiple, separated and distinct beam members located within each of at least some of the voids 114.

In some embodiments, the stabilizing cross-members 120 may be located substantially in a plane 122 (FIGS. 1E and 1F) that is oriented transverse to the deformable wall members 112. The plane 122 may be oriented substantially parallel to at least one of the first major surface 106 and the second major surface 108 of the first and second portions 102, 104. In some embodiments, the plane 122 in which the stabilizing cross-members 120 are located may be oriented substantially parallel to only one of the first major surface 106 and the second major surface 108 of the portions 102, 104, and at least a portion of the other of the first major surface 106 and the second major surface 108 may be oriented at an acute angle $\theta$ relative to the plane 122 in which the stabilizing cross-members 120 are located. As a non-limiting example, the acute angle $\theta$ may be in a range extending from about one degree (1°) to about twenty degrees (20°).

In some embodiments, each of the first and second portions 102, 104 of the portable cushion 100 may be tapered such that at least a portion of the first major surface 106 is oriented at an acute angle $\alpha$ relative to the second major surface 108. As a non-limiting example, the acute angle $\alpha$ may be in a range extending from about one degree (1°) to about twenty degrees (20°). In some embodiments, between about 20% and about 80%, between about 30% and about 70%, or even between about 40% and about 60% (e.g., about 50%) of the total area of the first major surface 106 may be oriented in a plane at an acute angle $\alpha$ relative to the second major surface 108, and a remainder of the total area of the first major surface 106 may be oriented in a plane substantially parallel to the second major surface 108.

As can be seen from FIGS. 1B and 3, in some embodiments, the deformable wall members 112 may be located and configured such that the voids 114 defined therebetween have a first average size (e.g., cross-sectional area) in a central region 124 of each of the first portion 102 and the second portion 104, and a second average size in at least one lateral side region 126 of each of the first portion 102 and the second portion 104, and the first average size may be greater than the second average size. In this configuration, the one or more lateral side regions 126 of each of the first portion 102 and the second portion 104 of the cushion 100 may be stiffer than the central region 124 of the first and second portions 102, 104. In such embodiments, a density of the deformable wall members 112 in the lateral side regions 126 may be higher than a density of the deformable wall members 112 in the central region 124 of each of the first portion 102 and the second portion 104 of the cushion 100.

As is also shown in FIGS. 1B and 3, at least some of the deformable wall members 112 may extend along an arcuate path laterally across each of the first portion 102 and the second portion 104 of the cushion 100. In some embodiments, the deformable walls 112 may have the shape and configuration of multiple overlapping rings (or portions of rings) that are displaced or shifted from one another along an axis, which, from the perspective of FIG. 1B, is oriented vertically in FIG. 1B in the embodiment shown in the figures. Such rings may be, for example, circular or oval. Additional deformable wall members 112 having other shapes may also be present. For example, in the embodiment shown in the figures, three straight deformable wall members 112 extend across each of the first and second portions 102, 104 of the cushion parallel to one another in a direction parallel to the axis along which the ring-shaped deformable wall members 112 are shifted relative to one another (the vertical direction from the perspective of FIG. 1B). Of course, the deformable wall members 112 may have any other shape in additional embodiments of cushions of the present disclosure.

Referring to FIG. 4, in some embodiments, each of the first portion 102 and the second portion 104 of the cushion 100 may have a cover 130 disposed over at least a portion of at least one of the first major surface 106 and the second major surface 108 thereof. In some embodiments, the cover 130 may not extend over at least a portion of one of the first major surface 106 and the second major surface 108, and the elastomeric material of the deformable wall members 112 may remain exposed at one of the first major surface 106 and the second major surface 108 of the first and second portions 102, 104 of the cushion 100. For example, as shown in FIG. 4, in some embodiments, a cover 130 may be disposed over the first major surface 106, and may at least substantially entirely cover the first major surface 106, but may not cover the second major surface 108 of the first and second portions 102, 104. In this configuration, the elastomeric material of the deformable wall members 112 may remain exposed at the second major surface 108 of each of the first and second portions 102, 104. In some embodiments, the second major surface 108 may be the surface configured to rest upon a chair or other surface of a support member, and the first major surface 106 may be the cushioning surface on which a person sits, or that otherwise cushions the body of a person or other object. In this configuration, the exposed elastomeric material on the second major surface 108 may serve to prevent slippage between the cushion 100 and the surface of the chair or other support member on which the cushion 100 is disposed.

Figure 5:
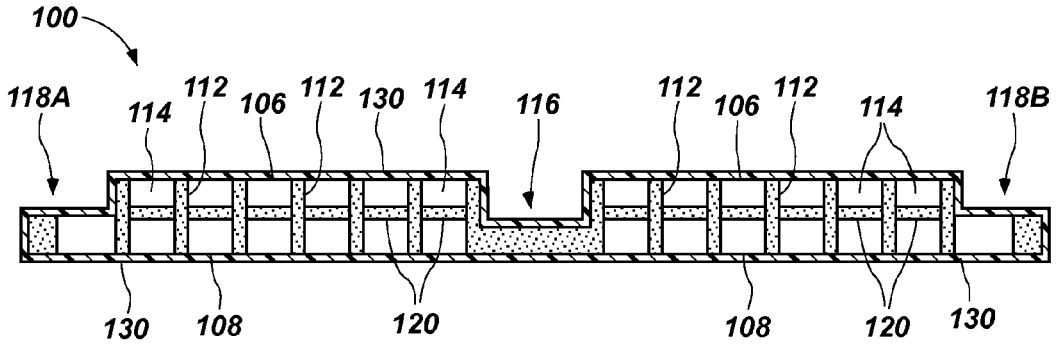
FIG. 5 is a simplified drawing of a front side view of the cushion of FIGS. 1A-1F and 2A-2F like that of FIG. 1C, and illustrates a cover encapsulating the cushion.

Referring to FIG. 5, in additional embodiments, a cover 130 may at least substantially encapsulate the deformable wall members 112 of the first and second portions 102, 104, such that the elastomeric material of the deformable wall members 112 is not exposed outside the cushion 100. In such a configuration, the cover 130 may extend over and at least substantially cover each of the first major surface 106 and the second major surface 108 of the first and second portions 102, 104 of the cushion 100.

The cover 130 may provide support to the deformable wall members 112 and may assist in stabilizing the position of the deformable wall members 112 when deformed during cushioning.

The cover 130 may be an elastomeric material, and may comprise a gelatinous elastomer, a thermoplastic elastomer, rubber, a synthetic elastomer, or a combination thereof. In some embodiments, the cover 130 may have the same composition as the deformable wall members 112, or the cover 120 may have a different composition. In embodiments in which the cover 130 and the deformable wall members 112 are of the same composition, the cover 130 may be integrally formed with the deformable wall members 112 or may be separately formed and subsequently attached thereto.

In additional embodiments, the cover 130 may comprise a woven or non-woven fabric. In such embodiments, the fabric may be a non-stretchable fabric, a limited-stretch fabric, or a stretchable fabric. As used herein, the term "non-stretchable fabric" means and includes a fabric that stretches elastically (exhibits elastic strain) less than about 2% (before breaking or plastically deforming) along a linear dimension, when tested according to standard stress-strain test methods, such as ASTM Standard D4964-96 (2008)e2, "Standard Test Method for Tension and Elongation of Elastic Fabrics (Constant-Rate-of-Extension Type Tensile Testing Machine)" (ASTM Intl, West Conshohocken, Pa., 2008). As used herein, the term "limited-stretch fabric" means and includes a fabric that stretches from about 2% to about 12% (before breaking or plastically deforming) along a linear dimension, when tested according to standard stress-strain test methods. As used herein, the term "stretchable fabric" means and includes a fabric that elastically stretches more than about 12% (before breaking or plastically deforming) along a linear dimension, when tested according to standard stress-strain test methods.

The cover 130 may be secured to the deformable wall members 112 by any appropriate means, such as by an adhesive, heat-fusing, stitching, etc. In embodiments in which the cover 130 is a fabric or a foam material, the cover 130 may define a plurality of voids (e.g., among fibers of the fabric or cell walls of the foam material) therein, and a portion of the material of the deformable wall members 112 may be melted and infiltrated into the voids, and subsequently cooled and solidified in a heat-fusing process, thereby securing the cover 130 to the deformable wall members 112.

Figure 6:
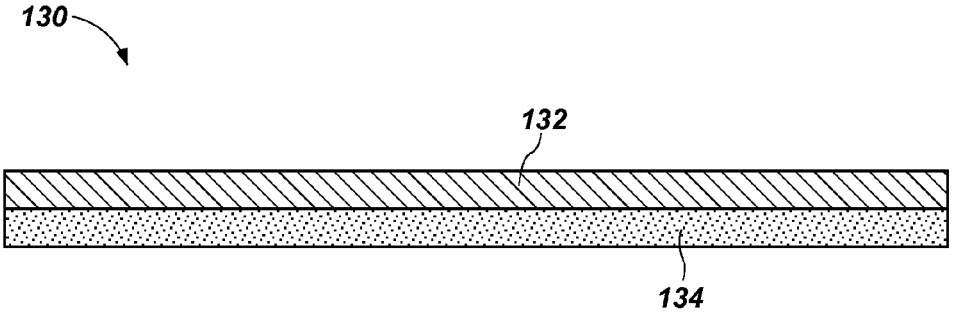
FIG. 6 is a simplified representation of a cross-sectional side view of a multi-layer cover that may be employed in embodiments of cushions as described herein.

Referring to FIG. 6, in some embodiments, the cover 130 may have a multi-layer structure, and may include a first outer fabric layer 132 and an inner polymeric layer 134. The outer fabric layer 132 may comprise a fabric as previously described, and the inner polymeric layer 134 may comprise an elastomeric material as previously described. In such embodiments, the inner polymeric layer 134 may be bonded to the elastomeric material of the deformable wall members 112 to secure the multi-layer cover 130 to the cushion 100.

Additional non-limiting example embodiments of the disclosure are described below.

Embodiment 1

A portable cushion, comprising: a generally planar first portion; and a generally planar second portion coupled with the first portion, the first portion and the second portion configured to fold relative to one another between a first state of the portable cushion in which the first portion and the second portion are disposed generally parallel to one another in a common plane, and a second state of the portable cushion in which the first portion and the second portion are disposed side-by-side and generally parallel to one another in separate planes, wherein each of the first portion and the second portion comprises: a first major surface and a second major surface; and deformable wall members extending between the first major surface and the second major surface, the deformable wall members located and configured to define voids therebetween such that the deformable wall members may be displaced into adjacent voids upon deformation of the deformable wall members, each of the deformable wall members comprising an elastomeric material; and wherein the first major surface of the first portion is disposed at least substantially coplanar with the first major surface of the second portion when the portable cushion is in the first state, and wherein one of the first major surface and the second major surface of the first portion is disposed adjacent one of the first major surface and the second major surface of the second portion when the portable cushion is in the second state.

Embodiment 2

The portable cushion of Embodiment 1, wherein the deformable wall members of the first portion and the deformable wall members of the second portion are part of a single, unitary body.

Embodiment 3

The portable cushion of Embodiment 2, wherein the portable cushion further includes a hinge member extending between the first portion and the second portion, and wherein at least a portion of the single, unitary body forms the hinge member.

Embodiment 4

The portable cushion of Embodiment 2 or Embodiment 3, wherein the portable cushion further includes a handle, and wherein at least a portion of the single, unitary body forms at least a portion of the handle.

Embodiment 5

The portable cushion of Embodiment 4, wherein each of the first portion and the second portion further includes at least a portion of the handle.

Embodiment 6

The portable cushion of any one of Embodiments 1 through 5, wherein each of the first portion and the second portion comprises a cover disposed over at least a portion of at least one of the first major surface and the second major surface.

Embodiment 7

The portable cushion of Embodiment 6, wherein the cover does not extend over at least a portion of one of the first major surface and the second major surface, the elastomeric material of the deformable wall members remaining exposed at one of the first major surface and the second major surface.

Embodiment 8

The portable cushion of Embodiment 6, wherein the cover at least substantially encapsulates the deformable wall members such that the elastomeric material of the deformable wall members is not exposed outside the cushion.

Embodiment 9

The portable cushion of any one of Embodiments 6 through 8, wherein the cover comprises a fabric.

Embodiment 10

The portable cushion of any one of Embodiments 6 through 9, wherein the cover has a multi-layer structure including a first outer fabric layer and an inner polymeric layer, the inner polymeric layer bonded to the deformable wall members.

Embodiment 11

The portable cushion of any one of Embodiments 1 through 10, wherein each of the first portion and the second portion further comprises stabilizing cross-members extending transversely between the deformable wall members, the stabilizing cross-members located and configured to counteract lateral deformation of the deformable wall members into the voids therebetween.

Embodiment 12

The portable cushion of Embodiment 11, wherein the stabilizing cross-members are located substantially in a plane oriented transverse to the deformable wall members.

Embodiment 13

The portable cushion of Embodiment 12, wherein the plane in which the stabilizing cross-members are located is oriented substantially parallel to at least one of the first major surface and the second major surface.

Embodiment 14

The portable cushion of Embodiment 12 or Embodiment 13, wherein the plane in which the stabilizing cross-members are located is oriented substantially parallel to only one of the first major surface and the second major surface, and wherein at least a portion of the other of the first major surface and the second major surface is oriented at an acute angle relative to the plane in which the stabilizing cross-members are located.

Embodiment 15

The portable cushion of Embodiment 14, wherein the acute angle is between about one degree (1°) and about twenty degrees (20°).

Embodiment 16

The portable cushion of any one of Embodiments 1 through 15, wherein at least a portion of each of the first portion and the second portion is tapered such that the first major surface is oriented at an acute angle to the second major surface.

Embodiment 17

The portable cushion of Embodiment 16, wherein the acute angle is between about one degree (1°) and about twenty degrees (20°).

Embodiment 18

The portable cushion of any one of Embodiments 1 through 17, wherein the deformable wall members are located and configured such that the voids defined therebetween have a first average size in a central region of each of the first portion and the second portion and a second average size in at least one lateral side region of each of the first portion and the second portion, the first average size being greater than the second average size, such that at least one lateral side region of each of the first portion and the second portion is stiffer than the central region.

Embodiment 19

The portable cushion of Embodiment 18, wherein a density of the deformable wall members in the at least one lateral side region is higher than a density of the deformable wall members in the central region of each of the first portion and the second portion.

Embodiment 20

The portable cushion of any one of Embodiments 1 through 19, wherein at least some of the deformable wall members extend along an arcuate path laterally across each of the first portion and the second portion.

Embodiment 21

A method of manufacturing a portable cushion, comprising: forming a generally planar first portion; and forming a generally planar second portion coupled with the first portion, the first portion and the second portion configured to fold relative to one another between a first state of the portable cushion in which the first portion and the second portion are disposed generally parallel to one another in a common plane, and a second state of the portable cushion in which the first portion and the second portion are disposed side-by-side and generally parallel to one another in separate planes, wherein each of the first portion and the second portion comprises: a first major surface and a second major surface, and deformable wall members extending between the first major surface and the second major surface, the deformable wall members located and configured to define voids therebetween such that the deformable wall members may be displaced into adjacent voids upon deformation of the deformable wall members, each of the deformable wall members comprising an elastomeric material; and wherein the first major surface of the first portion is disposed at least substantially coplanar with the first major surface of the second portion when the portable cushion is in the first state, and wherein one of the first major surface and the second major surface of the first portion is disposed adjacent one of the first major surface and the second major surface of the second portion when the portable cushion is in the second state.

Embodiment 22

The method of Embodiment 21, wherein forming the generally planar first portion and forming the generally planar second portion comprises forming a single, unitary body comprising each of the first portion and the second portion.

Embodiment 23

The method of Embodiment 22, wherein forming the single, unitary body further comprises forming the single, unitary body to comprise a hinge member extending between the first portion and the second portion.

Embodiment 24

The method of Embodiment 22 or Embodiment 23, wherein forming the single, unitary body further comprises forming the single, unitary body to comprise at least a portion of a handle of the portable cushion.

Embodiment 25

The method of Embodiment 24, wherein forming the single, unitary body to comprise at least a portion of a handle of the portable cushion further comprises forming each of the first portion and the second portion to include at least a portion of the handle.

Embodiment 26

The method of any one of Embodiments 21 through 25, further comprising disposing a cover over at least a portion of at least one of the first major surface and the second major surface of each of the first portion and the second portion.

Embodiment 27

The method of Embodiment 26, further comprising configuring the cover such that the cover does not extend over at least a portion of one of the first major surface and the second major surface, and leaving the elastomeric material of the deformable wall members exposed at one of the first major surface and the second major surface.

Embodiment 28

The method of Embodiment 26, further comprising at least substantially encapsulating the deformable wall members with the cover such that the elastomeric material of the deformable wall members is not exposed outside the cushion.

Embodiment 29

The method of any one of Embodiments 26 through 28, further comprising selecting the cover to comprise a fabric.

Embodiment 30

The method of any one of Embodiments 26 through 29, further comprising selecting the cover to have a multi-layer structure including a first outer fabric layer and an inner polymeric layer, and wherein disposing the cover over at least a portion of at least one of the first major surface and the second major surface of each of the first portion and the second portion further comprises bonding the inner polymeric layer bonded to the deformable wall members.

Embodiment 31

The method of any one of Embodiments 21 through 30, wherein forming the generally planar first portion and forming the generally planar second portion further comprises forming each of the first portion and the second portion to comprise stabilizing cross-members extending transversely between the deformable wall members, the stabilizing cross-members located and configured to counteract lateral deformation of the deformable wall members into the voids therebetween.

Embodiment 32

The method of Embodiment 31, further comprising locating the stabilizing cross-members substantially in a plane oriented transverse to the deformable wall members.

Embodiment 33

The method of Embodiment 31 or Embodiment 32, further comprising locating the stabilizing cross-members substantially in a plane oriented substantially parallel to at least one of the first major surface and the second major surface.

Embodiment 34

The method of any one of Embodiments 31 through 33, further comprising locating the stabilizing cross-members in a plane oriented substantially parallel to only one of the first major surface and the second major surface and oriented at an acute angle relative to at least a portion of the other of the first major surface and the second major surface.

Embodiment 35

The method of Embodiment 34, wherein the acute angle is between about one degree (1°) and about twenty degrees (20°).

Embodiment 36

The method of any one of Embodiments 21 through 35, further comprising forming each of the first portion and the second portion to have a tapered shape such that at least a portion of the first major surface is oriented at an acute angle to the second major surface.

Embodiment 37

The method of Embodiment 36, wherein the acute angle is between about one degree (1°) and about twenty degrees (20°).

Embodiment 38

The method of any one of Embodiments 21 through 37, further comprising locating and configuring the deformable wall members such that the voids defined therebetween have a first average size in a central region of each of the first portion and the second portion and a second average size in at least one lateral side region of each of the first portion and the second portion, the first average size being greater than the second average size, such that at least one lateral side region of each of the first portion and the second portion is stiffer than the central region.

Embodiment 39

The method of Embodiment 38, further comprising locating and configuring the deformable wall members such that a density of the deformable wall members in the at least one lateral side region is higher than a density of the deformable wall members in the central region of each of the first portion and the second portion.

Embodiment 40

The method of any one of Embodiments 21 through 39, further comprising locating and configuring the deformable wall members such that at least some of the deformable wall members extend along an arcuate path laterally across each of the first portion and the second portion.

Embodiments of the disclosure are susceptible to various modifications and alternative forms. Specific embodiments have been shown in the drawings and described in detail herein to provide illustrative examples of embodiments of the disclosure. However, the disclosure is not limited to the particular forms disclosed herein. Rather, embodiments of the disclosure may include all modifications, equivalents, and alternatives falling within the scope of the disclosure as broadly defined herein. Furthermore, elements and features described herein in relation to some embodiments may be implemented in other embodiments of the disclosure, and may be combined with elements and features described herein in relation to other embodiments to provide yet further embodiments of the disclosure.

What is claimed is:

1. A portable cushion, comprising:

a generally planar first portion; and a generally planar second portion coupled with the first portion, the first portion and the second portion configured to fold relative to one another between a first state of the portable cushion in which the first portion and the second portion are disposed generally parallel to one another in a common plane, and a second state of the portable cushion in which the first portion and the second portion are disposed side-by-side and generally parallel to one another in separate planes, wherein each of the first portion and the second portion comprises:

a first major surface;

a second major surface; and a plurality of deformable wall members extending between the first major surface and the second major surface, the deformable wall members located and configured to define a plurality of voids therebetween such that the deformable wall members may be displaced into adjacent voids upon deformation of the deformable wall members, wherein:

at least some of the deformable wall members extend along arcuate paths laterally across each of the first major surface and the second major surface;

the deformable wall members are located and configured such that the voids defined therebetween have a first average size in a central region of each of the first portion and the second portion and a second average size in at least one lateral side region of each of the first portion and the second portion, the first average size being greater than the second average size;

a density of the deformable wall members in the at least one lateral side region is higher than a density of the deformable wall members in the central region of each of the first portion and the second portion;

at least one lateral side region of each of the first portion and the second portion is stiffer than the central region; and each of the deformable wall members comprises an elastomeric material;

wherein the deformable wall members of the first portion and the deformable wall members of the second portion are part of a single, unitary body; and wherein the first major surface of the first portion is disposed at least substantially coplanar with the first major surface of the second portion when the portable cushion is in the first state, and wherein one of the first major surface and the second major surface of the first portion is disposed adjacent one of the first major surface and the second major surface of the second portion when the portable cushion is in the second state.

2. The portable cushion of claim 1, wherein the portable cushion further includes a hinge member extending between the first portion and the second portion, and wherein at least a portion of the single, unitary body forms the hinge member.

3. The portable cushion of claim 2, wherein the portable cushion further includes a handle, and wherein at least a portion of the single, unitary body forms at least a portion of the handle.

4. The portable cushion of claim 3, wherein each of the first portion and the second portion further includes at least a portion of the handle.

5. The portable cushion of claim 1, wherein each of the first portion and the second portion comprises a cover disposed over at least a portion of at least one of the first major surface and the second major surface.

6. The portable cushion of claim 5, wherein the cover does not extend over at least a portion of one of the first major surface and the second major surface, the elastomeric material of the deformable wall members remaining exposed at one of the first major surface and the second major surface.

7. The portable cushion of claim 5, wherein the cover has a multi-layer structure including a first outer fabric layer and an inner polymeric layer, the inner polymeric layer bonded to the deformable wall members.

8. The portable cushion of claim 1, wherein each of the first portion and the second portion further comprises stabilizing cross-members extending transversely between the deformable wall members, the stabilizing cross-members located and configured to counteract lateral deformation of the deformable wall members into the voids therebetween.

9. The portable cushion of claim 8, wherein the stabilizing cross-members are located substantially in a plane oriented transverse to the deformable wall members.

10. The portable cushion of claim 9, wherein the plane in which the stabilizing cross-members are located is oriented substantially parallel to at least one of the first major surface and the second major surface.

11. The portable cushion of claim 9, wherein at least a portion of one of the first major surface and the second major surface is oriented nonparallel to the plane in which the stabilizing cross-members are located.

12. The portable cushion of claim 1, wherein each of the first portion and the second portion is tapered such that at least a portion of the first major surface is oriented at an acute angle to the second major surface.

13. A method of manufacturing a portable cushion, comprising:

forming a single, unitary body comprising each of a generally planar first portion and a generally planar second portion, the first portion and the second portion configured to fold relative to one another between a first state of the portable cushion in which the first portion and the second portion are disposed generally parallel to one another in a common plane, and a second state of the portable cushion in which the first portion and the second portion are disposed side-by-side and generally parallel to one another in separate planes, wherein each of the first portion and the second portion comprises:

a first major surface;

a second major surface; and a plurality of deformable wall members extending between the first major surface and the second major surface, the deformable wall members located and configured to define a plurality of voids therebetween such that the deformable wall members may be displaced into adjacent voids upon deformation of the deformable wall members, wherein:

at least some of the deformable wall members extend along arcuate paths laterally across each of the first major surface and the second major surface;

the deformable wall members are located and configured such that the voids defined therebetween have a first average size in a central region of each of the first portion and the second portion and a second average size in at least one lateral side re ion of each of the first portion and the second portion, the first average size being greater than the second average size;

a density of the deformable wall members in the at least one lateral side region is higher than a density of the deformable wall members in the central region of each of the first portion and the second portion;

at least one lateral side region of each of the first portion and the second portion is stiffer than the central region; and each of the deformable wall members comprises an elastomeric material;

wherein the first major surface of the first portion is disposed at least substantially coplanar with the first major surface of the second portion when the portable cushion is in the first state, and wherein one of the first major surface and the second major surface of the first portion is disposed adjacent one of the first major surface and the second major surface of the second portion when the portable cushion is in the second state.

14. The method of claim 13, wherein forming the single, unitary body further comprises forming the single, unitary body to comprise a hinge member extending between the first portion and the second portion.

15. The method of claim 14, wherein forming the single, unitary body further comprises forming the single, unitary body to comprise at least a portion of a handle of the portable cushion.

16. The method of claim 15, wherein forming the single, unitary body to comprise at least a portion of the handle of the portable cushion further comprises forming each of the first portion and the second portion to include at least a portion of the handle.

17. The portable cushion of claim 1, wherein the single, unitary body comprises a single, unitary body of the elastomeric material.

18. The portable cushion of claim 4, wherein each of the first portion and the second portion, the hinge member, and the handle form a single integrally formed material.

19. The portable cushion of claim 1, wherein each of the first portion and the second portion comprises integrally formed stabilizing cross-members extending transversely between the deformable wall members in at least a portion of each of the first portion and the second portion.

20. The portable cushion of claim 1, wherein the first portion and the second portion are joined by an elastomeric hinge.

21. The portable cushion of claim 3, wherein the handle comprises an elastomeric material.

22. The portable cushion of claim 1, wherein the deformable wall members each exhibit an average thickness, and wherein a distance between adjacent deformable wall members is greater than the average thickness of the deformable wall members.

* * * * *

UNITED STATES PATENT AND TRADEMARK OFFICE

CERTIFICATE OF CORRECTION

PATENT NO. : 9,051,169 B2
APPLICATION NO. : 14/213229
DATED : June 9, 2015
INVENTOR(S) : Tony M. Pearce and Russell Whatcott It is certified that error appears in the above-identified patent and that said Letters Patent is hereby corrected as shown below:

In the specification:

COLUMN 7, LINE 8, change “FIGS,” to --FIGS.,--

In the claims:

CLAIM 13, COLUMN 17, LINE 12, change “re ion” to --region--

Signed and Sealed this
Twenty-second Day of December, 2015

Michelle K. Lee

Michelle K. Lee
*Director of the United States Patent and Trademark Office*